US007819680B2

(12) United States Patent
Hoyack et al.

(10) Patent No.: US 7,819,680 B2
(45) Date of Patent: Oct. 26, 2010

(54) SURFACE MOUNT COAXIAL CONNECTOR WITH SWITCHING FUNCTION

(75) Inventors: Michael A. Hoyack, Sandy Hook, CT (US); Owen R. Barthelmes, Putnam Valley, NY (US); Gino S. Antonini, New Fairfield, CT (US)

(73) Assignee: Amphenol Corporation, Wallingford, CT (US)

( * ) Notice: Subject to any disclaimer, the term of this patent is extended or adjusted under 35 U.S.C. 154(b) by 56 days.

(21) Appl. No.: 12/395,066

(22) Filed: Feb. 27, 2009

(65) Prior Publication Data

US 2010/0221940 A1 Sep. 2, 2010

(51) Int. Cl.
*H01R 29/00* (2006.01)

(52) U.S. Cl. ..... 439/188

(58) Field of Classification Search ..... 439/188, 439/507, 509, 513–515, 578; 200/5 R, 6 R
See application file for complete search history.

(56) References Cited

U.S. PATENT DOCUMENTS

| | | | | |
|---|---|---|---|---|
| 3,596,022 | A * | 7/1971 | Gaber et al. | 200/453 |
| 4,099,825 | A | 7/1978 | Jackson | |
| 4,412,108 | A * | 10/1983 | McCarty | 200/5 R |
| 5,562,464 | A * | 10/1996 | Lecourtois | 439/188 |
| 5,879,176 | A | 3/1999 | Stimson | |
| 5,936,581 | A * | 8/1999 | Roshitsh et al. | 343/702 |
| 6,547,592 | B2 | 4/2003 | Boillot | |
| 6,572,405 | B2 | 6/2003 | Lin et al. | |
| 6,645,011 | B2 | 11/2003 | Schneider et al. | |
| 6,709,289 | B2 | 3/2004 | Huber et al. | |
| 6,835,079 | B2 * | 12/2004 | Gentry et al. | 439/188 |
| 6,872,091 | B2 | 3/2005 | Huang | |
| 6,988,912 | B2 | 1/2006 | Bourgeas et al. | |
| 7,168,980 | B2 | 1/2007 | Peng | |
| 2007/0222538 | A1 | 9/2007 | Ornt et al. | |

FOREIGN PATENT DOCUMENTS

| | | | |
|---|---|---|---|
| EP | 0447660 | A1 | 9/1991 |
| WO | 9723929 | A1 | 7/1997 |

* cited by examiner

*Primary Examiner*—Chandrika Prasad
(74) *Attorney, Agent, or Firm*—Blank Rome LLP

(57) ABSTRACT

An electrical connector that comprises a body including an interface part adapted to engage a mating connector and a mounting part adapted to mount to a surface of a printed circuit board. An internal bore extends through the interface and mounting parts. A fixed interface contact is provided in the internal bore at the interface part. The fixed interface contact is configured to engage a corresponding contact of the mating connector. An actuating contact is received in the internal bore and is axially moveably within the internal bore between first and second positions. First and second stationary contacts are supported by the mounting part. Each of the first and second stationary contacts have a first contact end received in the internal bore of the body and a second exposed end that extends outside of the body for connection to the printed circuit board. The first and second stationary contacts define first and second electrical paths, respectively, wherein movement of the actuating contact between the first and second positions switches the electrical path between the first and second electrical paths, respectively.

25 Claims, 8 Drawing Sheets

SURFACE MOUNT COAXIAL CONNECTOR WITH SWITCHING FUNCTION

FIELD OF THE INVENTION

The present invention relates to a coaxial connector that is mounted to a printed circuit board. In particular, the present invention relates to a coaxial connector that provides a switching function and a fixed interface that is compliant with industry standards.

BACKGROUND OF THE INVENTION

Conventional RF connectors often handle cables transmitting data at frequencies up to 11 GHz. For example, type N, TNC, QN, 7/16 connectors are used in the telecommunications industry particularly because of their ability to handle higher powers required for signal transmission in wireless telecommunications systems. In particular, type N, TNC, QN, 7/16 connectors are often used in base stations for cellular telephones for connections with power amplifiers and transceivers, among other things.

Type N, TNC, QN, 7/16 connectors are configured to mate easily. To comply with interface standards (such as IEC, CECC, DIN or "QLF®" standards), the connectors are required to have certain specified dimensions. It is often uncertain whether the interface of switching connectors meets the type N, TNC, QN, or 7/16 standard unless it is engaged with it mating connector. Accordingly, there is a need for an RF connector that meets industry standards, such as the type N, TNC, QN, or 7/16 standards, without having to mate the RF connector with its mating connector.

SUMMARY OF THE INVENTION

Accordingly, an exemplary embodiment of the present invention is an electrical connector that comprises a body including an interface part adapted to engage a mating connector and a mounting part adapted to mount to a surface of a printed circuit board. An internal bore extends through the interface and mounting parts. A fixed interface contact is provided in the internal bore at the interface part. The fixed interface contact is configured to engage a corresponding contact of the mating connector. An actuating contact is received in the internal bore and is axially moveably within the internal bore between first and second positions. First and second stationary contacts are supported by the mounting part. Each of the first and second stationary contacts have a first contact end received in the internal bore of the body and a second exposed end that extends outside of the body for connection to the printed circuit board. The first and second stationary contacts define first and second electrical paths, respectively, wherein movement of the actuating contact between the first and second positions switches the electrical path between the first and second electrical paths, respectively.

Another exemplary embodiment of the present invention is an electrical connector that comprises a body including an interface part adapted to engage a mating connector and a mounting part adapted to mount to a surface of a printed circuit board. An internal bore extends through the interface and mounting parts. A fixed interface contact is provided in the internal bore at the interface part. The fixed interface contact is configured to engage a corresponding contact of the mating connector. An actuating subassembly is received in the internal bore and is axially moveably within the internal bore between first and second positions. The actuating subassembly includes an actuating contact, an insulator coupled to the actuating contact, and a plunger contact coupled to an end of the insulator. First and second stationary contacts are supported by the mounting part. Each of the first and second stationary contacts have a first contact end received in the internal bore of the body and a second exposed end extending outside of the body for connection to the printed circuit board. The plunger contact contacts the first stationary contact when the actuating contact is in the first position thereby defining a first electrical path. The actuating contact contacts the second stationary contact and the plunger contact is spaced from the first stationary contact when the actuating contact is in the second position thereby defining a second electrical path, wherein movement of the actuating subassembly between the first and second positions switches the electrical path between the first and second electrical paths, respectively.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
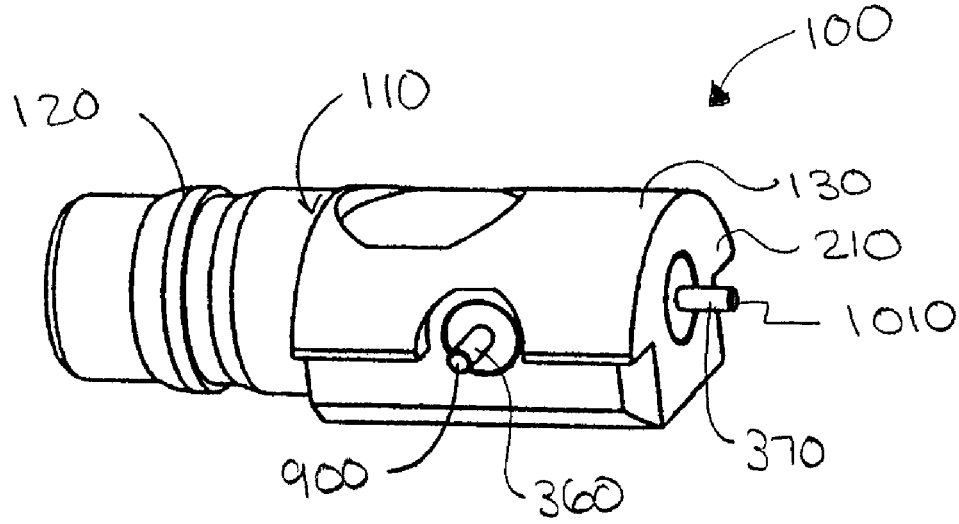
FIG. 1 is a perspective view of a coaxial connector according to an exemplary embodiment of the present invention.
Figure 2:
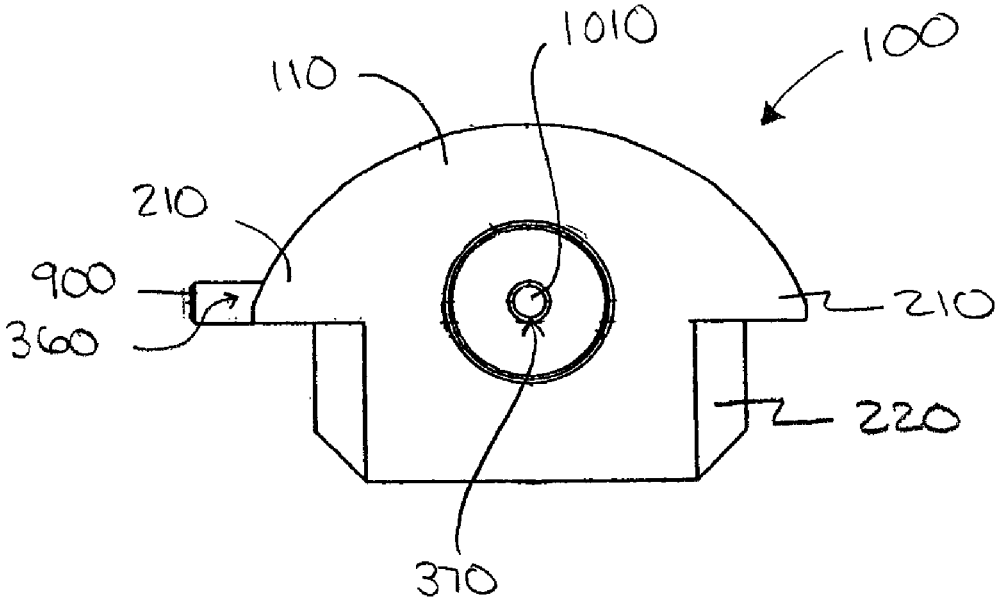
FIG. 2 is a end view of the coaxial connector illustrated in FIG. 1.
Figure 3:
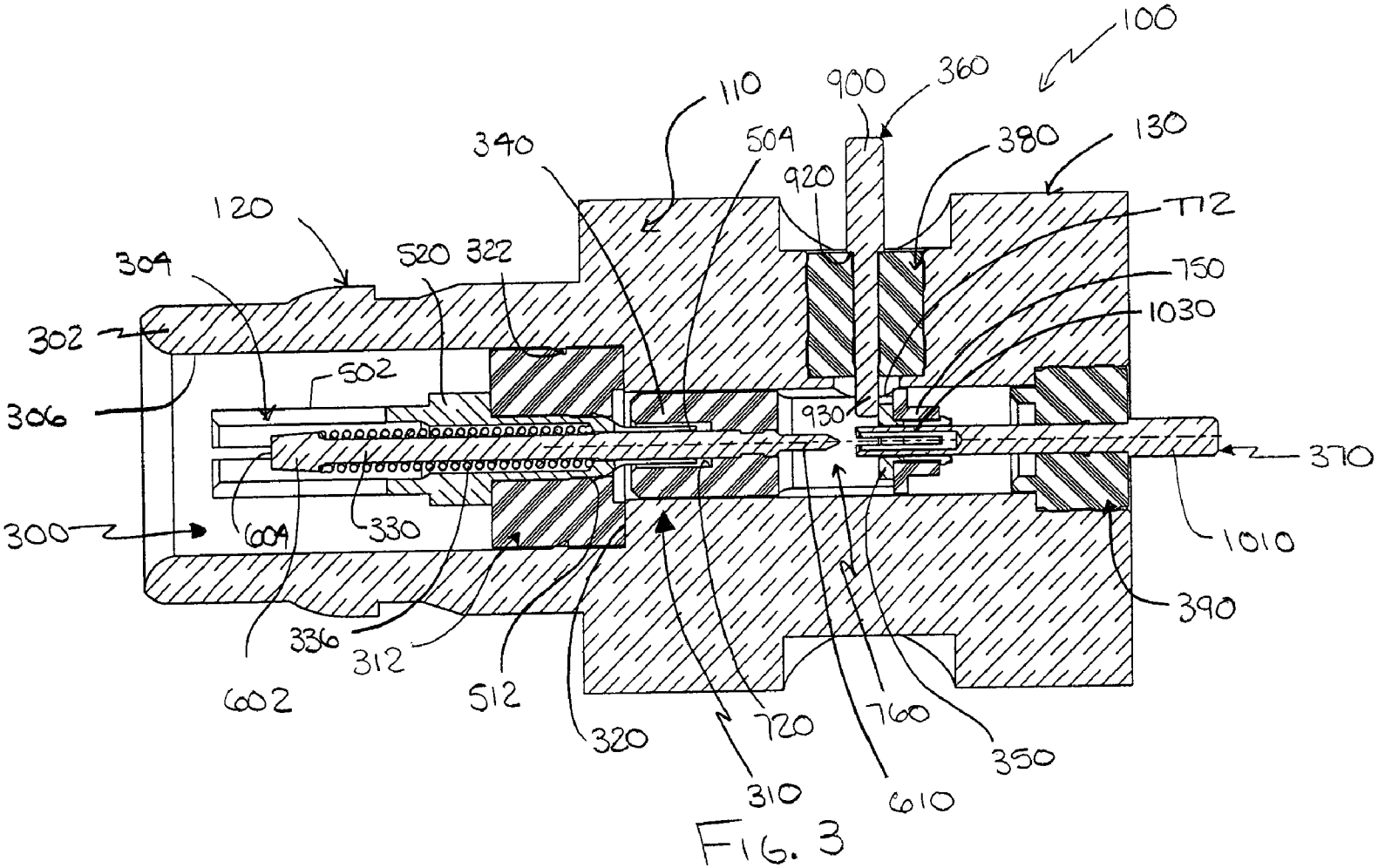
FIG. 3 is a cross-sectional view of the coaxial connector illustrated in FIG. 1.
Figure 4:
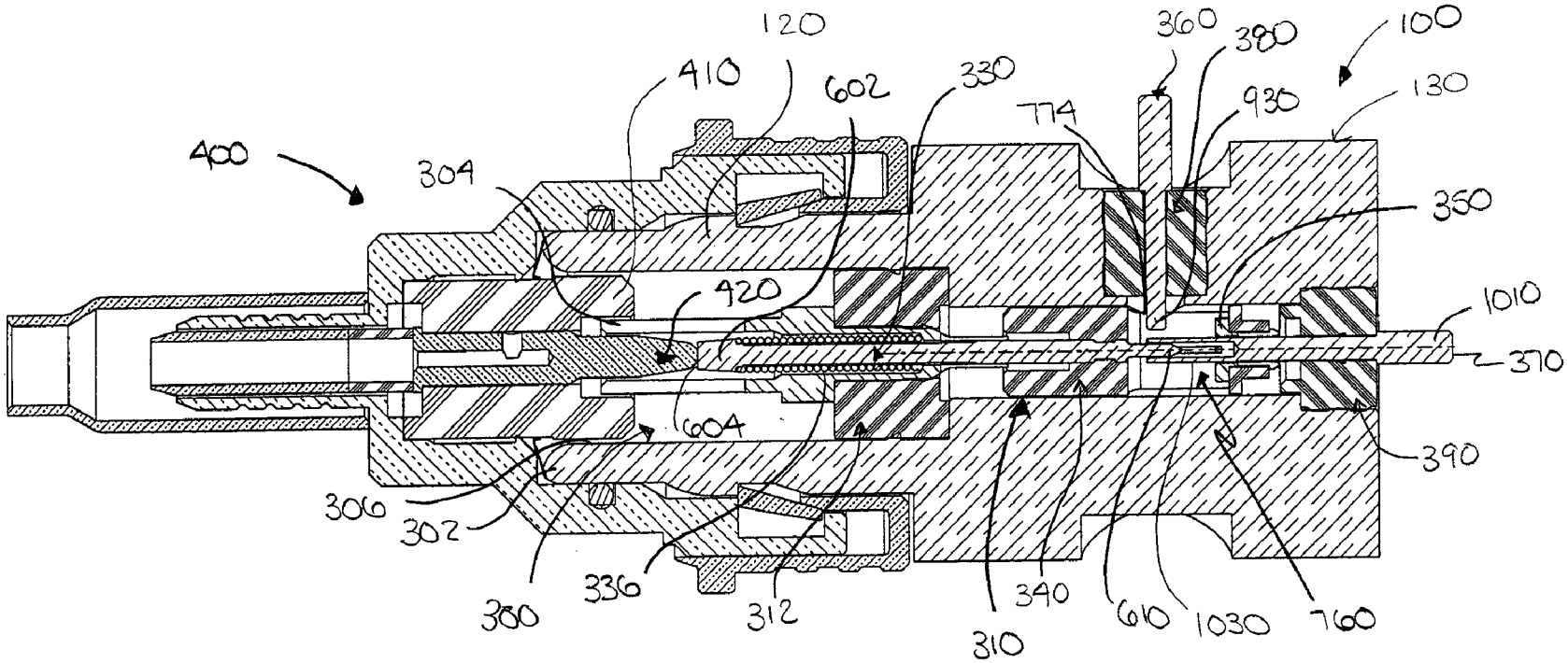
FIG. 4 is a cross-sectional view of a connector assembly, showing the coaxial connector according to an exemplary embodiment of the present invention mated with a mating connector.

Referring to FIGS. 1-4, a coaxial connector 100 in accordance with an exemplary embodiment of the present invention mounts to a printed circuit board and accepts a mating connector 400 (FIG. 4). The coaxial connector 100 provides a switching function and also provides a fixed mating interface, thereby meeting industry interface standards even when the connector is unmated. For example, the coaxial connector 100 meets the standards of RF connectors, such as type N, TNC, QN, and 7/16 connectors, and the like.

The coaxial connector 100 generally includes a conductive body 110 with an interface part 120 for interfacing with the mating connector 400 and a mounting part 130 for mounting to the printed circuit board. Extending through the body 110 is an internal bore 300 supporting the interface and switching components of the connector. FIG. 3 shows the connector 100 in an unmated position and particularly its actuating subassembly 310 in a first position establishing a first electrical path. FIG. 4 shows the connector 100 in a mated position receiving the mating connector 400 and particularly the actuating subassembly 310 in a second positioned establishing a second different electrical path. Wings 210 of the mounting part 130 extend outwardly from the connector's body 110.

As seen in FIG. 3, the interface part 120 of the connector 100 generally includes a mating interface 302 and a fixed interface contact 304 received in the internal bore 300. The mating interface 302 includes an access opening 306 adapted to receive the mating end 410 (FIG. 4) of the mating connector 400.

Figure 5A:
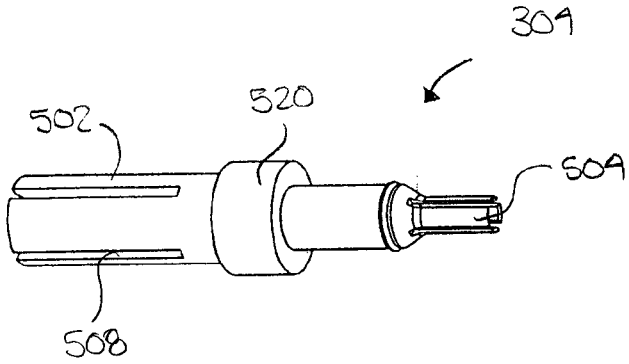
FIG. 5A is a perspective view of a fixed contact of the coaxial connector illustrated in FIG. 1.
Figure 5B:
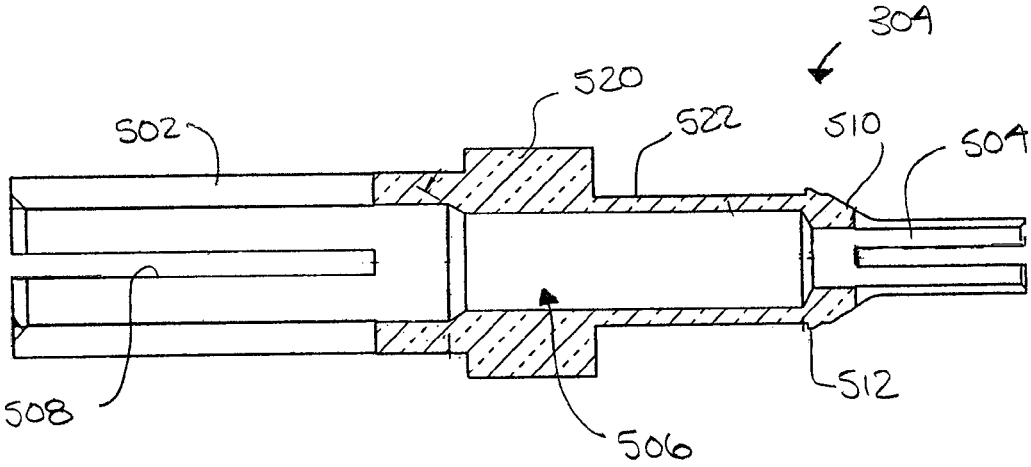
FIG. 5B is a cross-sectional view of the fixed contact illustrated in FIG. 5A.

As seen in FIGS. 3, 5A and 5B, the fixed interface contact 304 may include an interface end 502 and an opposite tail end 504. An inner bore 506 extends through the fixed contact 304 that receives the actuating subassembly 310. The interface end 502 is located near the mating interface 302 and is adapted to receive a pin 420 (FIG. 4) of the mating connector 400. The interface end 502 has a generally cylindrical shape with longitudinal slots 508, as best seen in FIG. 5A. The opposite tail end 504 is located near the mounting part 130 of the connector 100 and includes a sloped portion 510 with an outer tine 512 for grabbing a fixed insulator 312 (FIG. 3) fixed in the internal bore 300. A central shoulder 520 of the fixed contact 304 is located between the interface end 502 and the tail end 504 and defines an outer recessed area 522 that receives the insulator 312. The insulator 312 is sandwiched between the shoulder 520 and a step 320 of the connector's internal bore 300, as best seen in FIG. 3. Tines 322 extend inwardly from the inner surface of the connector's body 110 into the internal bore 300 that grab the fixed insulator 312. The contact 304 is held in position by an interference fit and the tine features. Because the insulator 312 is fixed in place in the internal bore 300, the fixed contact 304 extending through the insulator 312 is also fixed in place.

The actuating subassembly 310 slidably and axially moves within the connector's internal bore 300, and particularly within the fixed contact 304, as the connector 100 is mated and unmated with the mating connector 400. The mating and unmating of the connector provides the switching function between first and second stationary contacts 360 and 370 of the connector 100 as the actuating subassembly 310 moves between its first and second positions. The actuating subassembly 310 may include an actuating contact 330, an insulator 340, and a plunger contact 350.

Figure 6A:
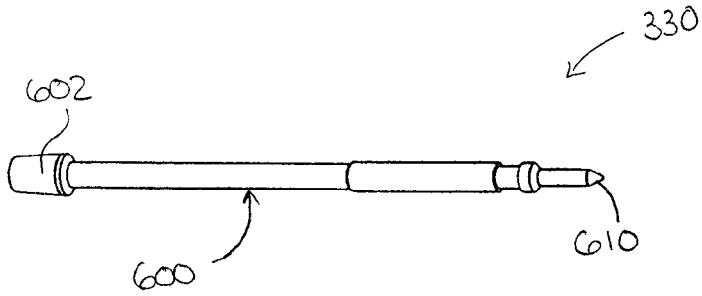
FIG. 6A is a perspective view of an actuating contact of the coaxial connector illustrated in FIG. 1.
Figure 6B:
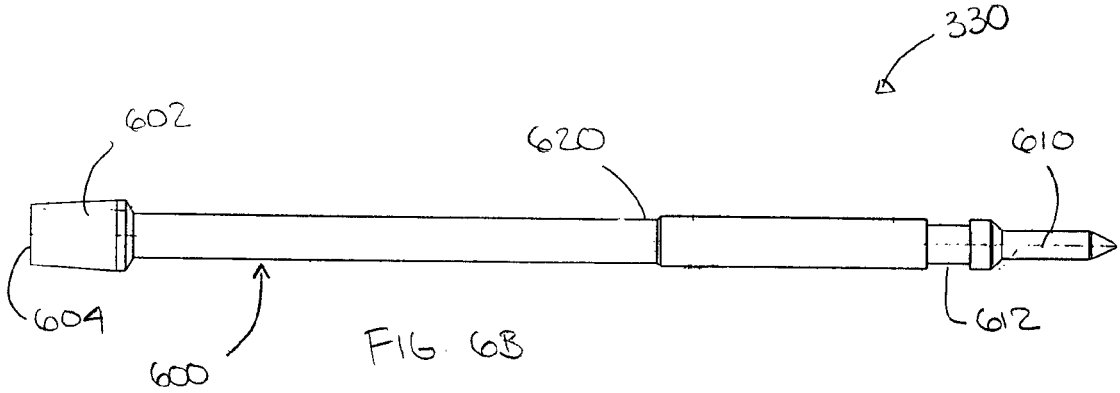
FIG. 6B is a side elevational view of the actuating contact illustrated in FIG. 6A.

As seen in FIGS. 6A and 6B, the actuating contact 330 has an elongated cylindrical body 600 sized to fit in the inner bore 506 of the fixed contact 304. A contact end 602 includes an abutment surface 604 (FIG. 6B) for contact with the pin 420 of the mating connector 400. Opposite the contact end 602 is a pin end 610 that is adapted to engage the second stationary contact 370. Between the contact end 602 and the pin end 610 is a recessed area 620 that receives a spring 336. The spring 336 biases the actuating subassembly 310 in the first position, as seen in FIG. 3, when the connector 100 is unmated. A groove 612 may be provided near the pin end 610 of the actuating contact 330 for engaging a corresponding portion of the insulator 340.

Figure 7A:
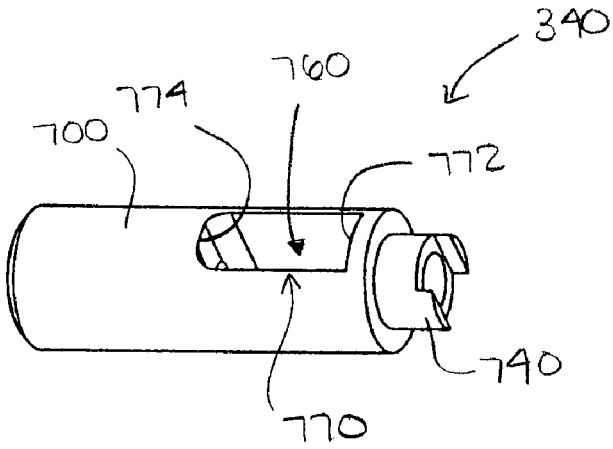
FIG. 7A is a perspective view of an insulator of the coaxial connector illustrated in FIG. 1.
Figure 7B:
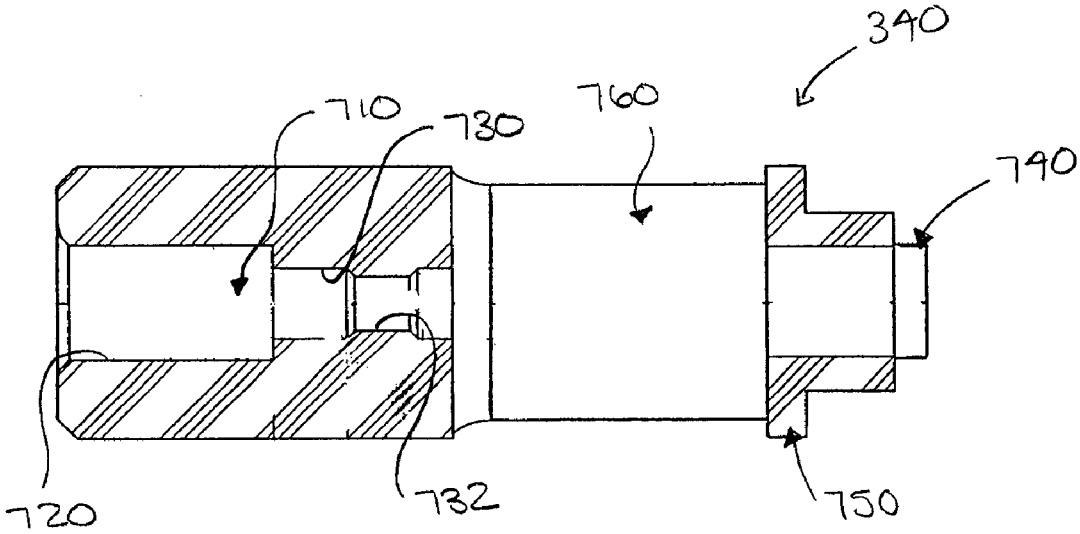
FIG. 7B is a cross-sectional view of the insulator illustrated in FIG. 7A.

The insulator 340 receives and is coupled to the actuating contact 330, as seen in FIG. 3. As seen in FIGS. 7A and 7B, the insulator 340 has a cylindrical body 700. An inner bore 710 extends through the body 700 for accepting the actuating contact 330. A first end portion 720 of the inner bore 710 is sized to accommodate the tail end 504 of the fixed contact 304 in addition to the actuating contact 330, as seen in FIG. 3. A middle portion 730 of the inner bore 710 includes a stepped-in portion 732 that snaps into the groove 612 of the actuating contact 330. A second end portion 740 opposite the first end portion 720 includes a seat 750 that supports the plunger contact 350, as seen in FIGS. 3 and 4.

Between the middle portion 730 and the second end portion 740, the insulator 340 is hollow to provide a switching area 760 (FIG. 7B). The switching area 760 includes an access slot 770 that receives the first stationary contact 360, as seen in FIGS. 3 and 4. The slot 770 includes opposite ends 772 and 774, as seen in FIG. 7A.

Figure 8A:
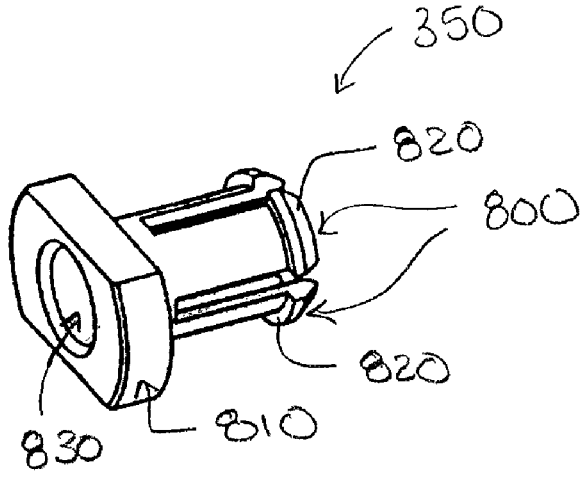
FIG. 8A is a perspective view of a plunger contact of the coaxial connector illustrated in FIG. 1.
Figure 8B:
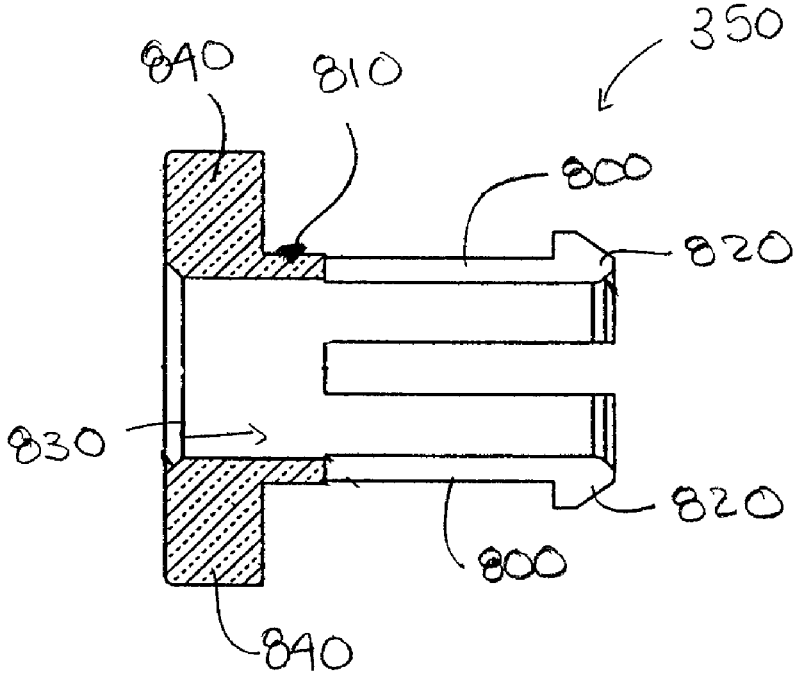
FIG. 8B is a cross-sectional view of the plunger contact illustrated in FIG. 8A.

As seen in FIGS. 8A and 8B, the plunger contact 350 may include a plurality of resilient fingers 800 extending from a base 810. The fingers 800 are configured to extend through the seat 750 of the insulator 340 and include ribs 820 at their terminal ends that snap onto the seat 750. The base 810 includes a central opening 830 adapted to slidably receive the second stationary contact 370. Wings 840 of the base 810 contact the first stationary contact 360 when the connector 100 is in the unmated position.

As seen in FIG. 3, the mounting part 130 of the connector's body 110 supports the first and second stationary contacts 360 and 370 via fixed insulators 380 and 390 such that the first and second stationary contacts 360 and 370 are substantially perpendicular to one another.

Figure 9:
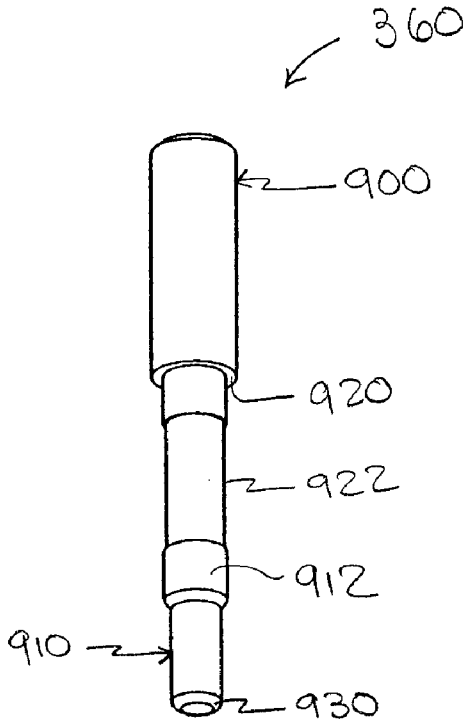
FIG. 9 is a perspective view of a stationary contact of the coaxial connector illustrated in FIG. 1.

As seen in FIG. 9, the first stationary contact 360 may include first and second portions 900 and 910. The first portion 900 is exposed and extends outside of the connector's body for contact with the printed circuit board. The second portion 910 extends through the fixed insulator 380 and may include a radial rib 912 for engaging the fixed insulator 380. The first portion 900 of the first stationary contact 360 has a larger diameter than the second portion 910, thereby defining a shoulder 920 and a recessed area 922. The recessed area 922 of the stationary contact 360 accepts the insulator 380 with the insulator 380 abutting the contact's shoulder 920, as seen in FIG. 3. A terminal end 930 of the second portion 910 of the stationary contact 360 extends into the connector's internal bore 300 through the access slot 770 and into the switching area 760 of the actuating subassembly's insulator 340, as seen in FIGS. 3 and 4. When the connector 100 is unmated, as shown in FIG. 3, the stationary contact's second portion 910 extends through the slot 770 near its first end 772. When the connector 100 is mated with mating connector 400, as shown in FIG. 4, the stationary contact's second portion 910 extends through the slot's second end 774.

Figure 10:
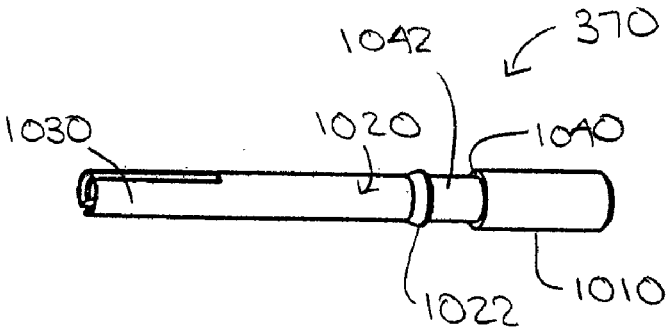
FIG. 10 is a perspective view of a stationary contact of the coaxial connector illustrated in FIG. 1.

As seen in FIG. 10, the second stationary contact 370 may include an exposed end portion 1010 that steps down to a middle portion 1020 that may include an outwardly extending tine 1022 for engaging the fixed insulator 390. The second stationary contact 370 also includes a receiving end 1030 opposite the exposed end 1010 configured to receive the pin end 610 of the actuating contact 330. The exposed end portion 1010 has a larger diameter than the receiving end 1030 to define a shoulder 1040 and a recess 1042. The second stationary contact 370 extends through the fixed insulator 390 until the insulator 390 abuts the contact's shoulder 1040 allowing the insulator 390 to rest in the recess 1042. The receiving end 1030 of the second stationary contact 370 extends into the connector's internal bore 300, through the plunger contact 350 and into the switching area 760 of the actuating subassembly's insulator 340.

In use, the wings 210 of the connector's body 110 are configured to rest on the surface of the printed circuit board allowing the exposed ends 900 and 1010 of the first and second stationary contacts 360 and 370 to contact the printed circuit board, such as by soldering. When mounted on the board, the remaining potion 220 of the connector's body 110 sits in an opening or slot (not shown) of the printed circuit board.

FIGS. 3 and 4 illustrate the unmated and mated positions of the connector 100, respectively, and particularly show the movement of the actuating subassembly 310 to switch from the first electrical path defined through the first stationary contact 360 to the second electrical path defined through the second stationary contact 370.

As seen in FIG. 3, when the connector 100 is in the unmated position, the actuating subassembly 310 is positioned away from the second stationary contact 370 such that its insulator 340 abuts the fixed insulator 312 and the plunger contact 350 abuts the terminal end 930 of the first stationary contact 360 defining the first electrical path. The seat 750 abuts the plunger contact 350 and because the seat 750 is part of the insulator 340, the subassembly is held in place with the pin end 610 of the actuating contact 330 not making contact with the receiving end 1030 of the second stationary contact 370. In this first position, the terminal end 930 of the first stationary contact 360 extends through the access slot 770 near its first end 772 and into the switching area 760. Also in this position, the pin end 610 of the actuating contact 330 of the actuating subassembly 310 is spaced from and thus not in contact with the second stationary contact 370.

When the mating connector 400 is plugged into the connector 100, as seen in FIG. 4, the actuating contact 330 of the actuating subassembly 310 moves axially into contact with the second stationary contact 370 thereby creating the second electrical path. In particular, the pin 420 of the mating connector 400 abuts the abutment surface 604 of the contact end 602 of the actuating contact 330 and forces the actuating subassembly 310 to axially move against the bias of the spring 336. As the actuating subassembly 310 moves axially, the plunger contact 350 separates from the terminal end 930 of the first stationary contact 360 in the switching area 760 to break electrical contact. The terminal end 930 now extends through the slot 770 near its second end 774. The pin end 610 of the actuating contact 330 then slides into the receiving end 1030 of the second stationary contact 370 establishing an electrical connection and switching the electrical path from the first stationary contact 360 to the second stationary contact 370. Upon removal of the mating connector 400 from the connector 100, the spring forces the actuating subassembly 310 back to its original unmated position.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising of:

a body including an interface part adapted to engage a mating connector and a mounting part adapted to mount to a surface of a printed circuit board, and an internal bore extending through said interface and mounting parts;

a fixed interface contact provided in said internal bore at said interface part, said fixed interface contact being configures to engage a corresponding contact of the mating connector;

an actuating contact received in said internal bore and axially moveably within said internal bore between first and second positions; and first and second stationary contacts supported by said mounting part, each of said first and second stationary contacts having a first contact end received in said internal bore of said body and a second exposed end extending outside of said body for connection to the printed circuit board, whereby said first and second stationary contacts define first and second electrical paths, respectively, wherein movement of said actuating contact between said first and second positions switches the electrical path between said first and second electrical paths, respectively.

2. An electrical connector according to claim 1, further comprising a plunger contact axially moveable in said internal bore, said plunger contact being in contact with said first stationary contact when said actuating contact is in said first position, and said plunger contact being in contact with said second stationary contact when said actuating contact is in said second position.

3. An electrical connector according to claim 1, further comprising an insulator coupled to said actuating contact, said insulator including an inner switching area for receiving said first contact ends of said first and second stationary contacts.

4. An electrical connector according to claim 3, wherein said insulator includes an inner bore through which said actuating contact extends and that receives an end of said fixed interface contact.

5. An electrical connector according to claim 3, wherein said insulator includes a slot providing access to said inner switching area and that is adapted to receive said first contact end of said first stationary contact.

6. An electrical connector according to claim 3, further comprising a plunger contact supported by said insulator remote from said actuating contact, whereby said actuating contact, said insulator, and said plunger contact move axially as a subassembly within said internal bore such that said plunger contact contacts said first stationary contact when said actuating contact is in said first position, and said plunger contact contacts said second stationary contact when said actuating contact is in said second position.

7. An electrical connector according to claim 1, wherein said actuating contact is received within an inner bore of said fixed interface contact so that said actuating contact slides within said fixed interface contact.

8. An electrical connector according to claim 7, wherein a spring is disposed around a main portion of said actuating contact and in said inner bore of said fixed interface contact, said spring biasing said actuating contact towards said first position.

9. An electrical connector according to claim 1, further comprising a fixed insulator disposed in said internal bore at said fixed interface part that receives a portion of said fixed interface contact.

10. An electrical connector according to claim 1, further comprising said actuating contact includes a contact end and an opposite pin end, said contact end including an abutment surface for engaging the corresponding contact of the mating connector, and said pin end being configured to engage said second stationary contact when said actuating contact is in said second position.

11. An electrical connector according to claim 1, wherein said first and second stationary contacts are substantially perpendicular to one another.

12. An electrical connector according to claim 1, wherein each of said first and second stationary contacts are supported in said mounting part by an insulator.

13. An electrical connector according to claim 1, wherein said body includes wing portions extending from opposite sides thereof, said wing portions being configured to rest on the printed circuit board.

14. An electrical connector according to claim 1, wherein said body is a one-piece conductive body.

15. An electrical connector, comprising of:

a body including an interface part adapted to engage a mating connector and a mounting part adapted to mount to a surface of a printed circuit board, and an internal bore extending through said interface and mounting parts;

a fixed interface contact provided in said internal bore at said interface part, said fixed interface contact being configures to engage a corresponding contact of the mating connector;

an actuating subassembly received in said internal bore and axially moveably within said internal bore between first and second positions including, an actuating contact, an insulator coupled to said actuating contact, and a plunger contact coupled to an end of said insulator; and first and second stationary contacts supported by said mounting part, each of said first and second stationary contacts having a first contact end received in said internal bore of said body and a second exposed end extending outside of said body for connection to the printed circuit board, whereby said plunger contact contacts said first stationary contact when said actuating contact is in said first position thereby defining a first electrical path; and said actuating contact contacts said second stationary contact and said plunger contact is spaced from said first stationary contact when said actuating contact is in said second position thereby defining a second electrical path, wherein movement of said actuating subassembly between said first and second positions switches the electrical path between said first and second electrical paths, respectively.

16. An electrical connector according to claim 15, wherein said insulator including an inner switching area for receiving the first contact ends of said first and second stationary contacts.

17. An electrical connector according to claim 15, wherein said actuating contact has a contact end and an opposite pin end, said contact end includes an abutting surface for abutting the corresponding contact of the mating connector, and said pin end being adapted to be received in said first contact end of said second stationary contact.

18. An electrical connector according to claim 15, wherein said actuating contact of said actuating subassembly is slidably received in an inner bore of said fixed interface contact.

19. An electrical connector according to claim 18, further comprising a spring located around said actuating contact and disposed in said inner bore of said fixed interface contact.

20. An electrical connector according to claim 15, wherein said plunger contact slidably receives said second stationary contact.

21. An electrical connector according to claim 15, wherein said insulator of said actuating subassembly includes an inner bore through which said actuating contact extends and that receives an end of said fixed interface contact.

22. An electrical connector according to claim 15, wherein each of said first and second stationary contacts being supported by an insulator.

23. An electrical connector according to claim 22, wherein said first and second stationary contacts being arranged substantially perpendicular to one another in said mounting part.

24. An electrical connector according to claim 15, wherein said body includes wing portions extending from opposite sides thereof.

25. An electrical connector according to claim 15, wherein said body is a one-piece conductive body.

* * * * *